US010192521B2

(12) United States Patent
Xiao

(10) Patent No.: US 10,192,521 B2
(45) Date of Patent: Jan. 29, 2019

(54) GAMMA ADJUSTMENT METHOD

(71) Applicants: BOE TECHNOLOGY GROUP CO., LTD., Beijing (CN); BEIJING BOE MULTIMEDIA TECHNOLOGY CO., LTD., Beijing (CN)

(72) Inventor: Xiangchun Xiao, Beijing (CN)

(73) Assignees: BOE Technology Group Co., Ltd., Beijing (CN); Beijing BOE Multimedia Technology Co., Ltd., Beijing (CN)

( * ) Notice: Subject to any disclaimer, the term of this patent is extended or adjusted under 35 U.S.C. 154(b) by 0 days.

(21) Appl. No.: 15/526,638

(22) PCT Filed: Jan. 3, 2017

(86) PCT No.: PCT/CN2017/000029
§ 371 (c)(1),
(2) Date: May 12, 2017

(87) PCT Pub. No.: WO2017/173863
PCT Pub. Date: Oct. 12, 2017

(65) Prior Publication Data

US 2018/0197504 A1 Jul. 12, 2018

(30) Foreign Application Priority Data

Apr. 7, 2016 (CN) ..... 2016 1 0214546

(51) Int. Cl.
*G09G 5/10* (2006.01)

(52) U.S. Cl.
CPC ..... *G09G 5/10* (2013.01); *G09G 2320/0276* (2013.01); *G09G 2320/0673* (2013.01)

(58) Field of Classification Search
CPC ..... G09G 5/10; G09G 2320/0276; G09G 2320/0673; G09G 2320/0626; H04N 5/202
See application file for complete search history.

(56) References Cited

U.S. PATENT DOCUMENTS 8,013,877 B2 * 9/2011 Ou-Yang ..... G09G 3/20 345/690
2014/0022287 A1 * 1/2014 Ahn ..... G09G 3/3607 345/690
2016/0351139 A1 * 12/2016 Syu ..... G09G 3/36

FOREIGN PATENT DOCUMENTS

CN 103295550 A 9/2013
CN 103325357 A 9/2013
(Continued)

OTHER PUBLICATIONS

First Office Action dated Mar. 29, 2017 in corresponding Chinese Application No. 201610214546.6.
(Continued)

*Primary Examiner* — Antonio A Caschera
(74) *Attorney, Agent, or Firm* — Nath, Goldberg & Meyer; Joshua B. Goldberg; Daniel Bissing

(57) ABSTRACT

The present invention relates to a gamma adjustment method, which includes: measuring a minimum brightness value $L_{min}$ and a maximum brightness value $L_{max}$ of a display panel; wherein the minimum brightness value $L_{min}$ is a brightness value at gray level 0, and the maximum brightness value $L_{max}$ is a brightness value at gray level n; calculating value of a first intermediate parameter x according to formula
(Continued)

$$\frac{L_{min}}{L_{max}} = \left(\frac{x}{n}\right)^m,$$

where m is a gamma value of the display panel; calculating value of a second intermediate parameter y according to formula $$y = \frac{n-x}{n};$$

calculating a brightness value $L_z$ at gray level z according to formula $$L_z = \left(\frac{x+z\times y}{n}\right)^m \times L_{max} \text{ or } L_z = \left(\frac{x+z\times y}{x}\right)^m \times L_{min},$$

where z is an integer ranging from 1 to (n−1); and adjusting the brightnesses of the display panel based on the minimum brightness value $L_{min}$, the maximum brightness value $L_{max}$, and the brightness values at gray level 1 to gray level (n−1).

5 Claims, 4 Drawing Sheets

(56) References Cited

FOREIGN PATENT DOCUMENTS

| | | | |
|---|---|---|---|
| CN | 104361873 | A | 2/2015 |
| CN | 105096827 | A | 11/2015 |
| CN | 105632460 | A | 6/2016 |
| JP | 2008-129334 | A | 6/2008 |

OTHER PUBLICATIONS

International Search Report dated Feb. 24, 2017 issued in corresponding International Application No. PCT/CN2017/000029 along with English translation of the Written Opinion of the International Searching Authority.

* cited by examiner

| gray level | brightness value 1/nits | brightness value 2/nits |
|---|---|---|
| 0 | 0.4336 | 0 |
| 1 | 0.532932051 | 0.002871073 |
| 2 | 0.643532473 | 0.013191987 |
| 3 | 0.765596204 | 0.032189259 |
| 4 | 0.899306132 | 0.060614453 |
| 5 | 1.044833757 | 0.099032609 |
| 6 | 1.202341524 | 0.147902993 |
| 7 | 1.371983422 | 0.207615561 |
| 8 | 1.553905994 | 0.278510892 |
| 9 | 1.748249101 | 0.360892397 |
| ⋮ | | |
| 96 | 75.49203381 | 65.92360143 |
| 97 | 77.06513656 | 67.44379935 |
| 98 | 78.65595213 | 68.9829208 |
| 99 | 80.26451344 | 70.54100462 |
| 100 | 81.89085319 | 72.11808935 |
| 101 | 83.53500383 | 73.71421324 |
| 102 | 85.19699758 | 75.32941421 |
| 103 | 86.87686642 | 76.96372988 |
| 104 | 88.5746421 | 78.61719759 |
| ⋮ | | |
| 149 | 183.9847011 | 173.4019603 |
| 150 | 186.5372181 | 175.9725722 |
| 151 | 189.1089302 | 178.5638316 |
| 152 | 191.6998612 | 181.1757658 |
| 153 | 194.3100349 | 183.8084023 |
| 154 | 196.9394751 | 186.4617681 |
| ⋮ | | |
| 249 | 537.7316987 | 536.6396725 |
| 250 | 542.3068184 | 541.3924953 |
| 251 | 546.9030887 | 546.1681866 |
| 252 | 551.5205258 | 550.9667645 |
| 253 | 556.159146 | 555.7882472 |
| 254 | 560.8189654 | 560.6326531 |
| 255 | 565.5 | 565.5 |

FIG. 4

GAMMA ADJUSTMENT METHOD

TECHNICAL FIELD

The present invention relates to the field of display technology, and particularly relates to a gamma adjustment method.

BACKGROUND

In the field of display technology, after preparation of a display panel, brightness at each gray level needs to be adjusted based on a predetermined gamma curve, so that the brightness corresponding to each gray level of the display panel conforms to the predetermined gamma curve, and as a result, it is ensured that the display panel can accurately display details of different brightnesses in an image during display of the image.

In the prior art, brightness of a display panel at each gray level is generally adjusted according to an ideal gamma curve of the display panel. However, for a display panel whose brightness corresponding to the minimum gray level is not zero, gamma adjustment directly using the ideal gamma curve may result in compression of brightness difference among low gray levels, and the adjusted display panel cannot clearly display image information at low gray levels.

SUMMARY

The present invention aims to solve at least one of the technical problems existing in the prior art, and proposes a gamma adjustment method, which can ensure brightness differences among low gray levels, and thus improve display effect of the adjusted display panel with respect to image information at low gray levels.

To achieve the object of the present invention, there is provided a gamma adjustment method for adjusting brightnesses of a display panel, wherein the display panel has (n+1) gray levels, where n is an integer larger than or equal to 2, and the gamma adjustment method comprises: measuring a minimum brightness value $L_{min}$ and a maximum brightness value $L_{max}$ of the display panel; wherein the minimum brightness value $L_{min}$ is a brightness value at gray level 0, and the maximum brightness value $L_{max}$ is a brightness value at gray level n;

calculating a value of a first intermediate parameter x according to a formula of $$\frac{L_{min}}{L_{max}} = \left(\frac{x}{n}\right)^m,$$

where m is a gamma value of the display panel;

calculating a value of a second intermediate parameter y according to a formula of $$y = \frac{n-x}{n};$$

calculating a brightness value $L_z$ at gray level z according to a formula of $$L_z = \left(\frac{x+z\times y}{n}\right)^m \times L_{max} \text{ or } L_z = \left(\frac{x+z\times y}{x}\right)^m \times L_{min},$$

where z is an integer ranging from 1 to (n−1); and adjusting the brightnesses of the display panel based on the measured minimum brightness value $L_{min}$, the measured maximum brightness value $L_{max}$, and the calculated brightness values at gray level 1 to gray level (n−1).

Optionally, the gamma value m of the display panel is equal to 2.2.

Optionally, the number of gray levels of the display panel is 256 or 64.

Optionally, after calculating the brightness values at gray level 1 to gray level (n−1), and before adjusting the brightnesses of the display panel, brightness values of the display panel at a part of the gray levels are adjusted adaptively according to visual perception of different users.

Optionally, in a step of calculating a brightness value $L_z$ at gray level z according to the formula of $$L_z = \left(\frac{x+z\times y}{n}\right)^m \times L_{max},$$

a value of z is made to be equal to integers ranging from 1 to (n−1) sequentially, so as to calculate the brightness values of the display panel at gray level 1 to gray level (n−1).

The present invention has the beneficial effects as follows:

in the gamma adjustment method provided by the present invention, the minimum brightness value $L_{min}$ and the maximum brightness value $L_{max}$ of the display panel are detected to determine positions of gray level 0 and gray level n of the display panel in the ideal gamma curve, then gray level difference, corresponding to adjacent gray levels of the display panel, in the ideal gamma curve is calculated based on the positions of gray level 0 and gray level n of the display panel in the ideal gamma curve, thus positions of gray levels 1 to (n−1) of the display panel in the ideal gamma curve can be calculated, and based on this, the brightness values of the display panel at gray levels 1 to (n−1) can be calculated according to the ideal gamma curve; the fabricated display panel may be adjusted by taking the detected brightness value $L_{min}$ at gray level 0, the calculated brightness values at gray levels 1 to (n−1), and the detected brightness value $L_{max}$ at gray level n as the standard brightness values. As compared with the prior art, even when the minimum brightness value $L_{min}$ of the display panel is not equal to 0, brightness differences of the display panel at low gray levels can be avoided from being compressed, thereby ensuing display effect of image information at low gray levels.

BRIEF DESCRIPTION OF THE FIGURES

The accompanying drawings, which serve to provide a further understanding of the present invention and constitute a part of this specification, are used for explaining the present invention together with the following specific implementations, rather than limiting the present disclosure. In the drawings:

FIG. 4 is a comparison table illustrating brightness, at each gray level, of a display panel having 256 gray levels after undergoing gamma adjustment by directly using an existing ideal gamma curve, and brightness, at each gray level, of the display panel after undergoing gamma adjustment by using a gamma adjustment method according to the embodiments of the present invention.

DETAILED DESCRIPTION

Specific implementations of the present invention will be described in detail below in conjunction with the accompanying drawings. It should be understood that the specific implementations described herein are merely used for describing and explaining the present invention, rather than limiting the present invention.

Figure 1:
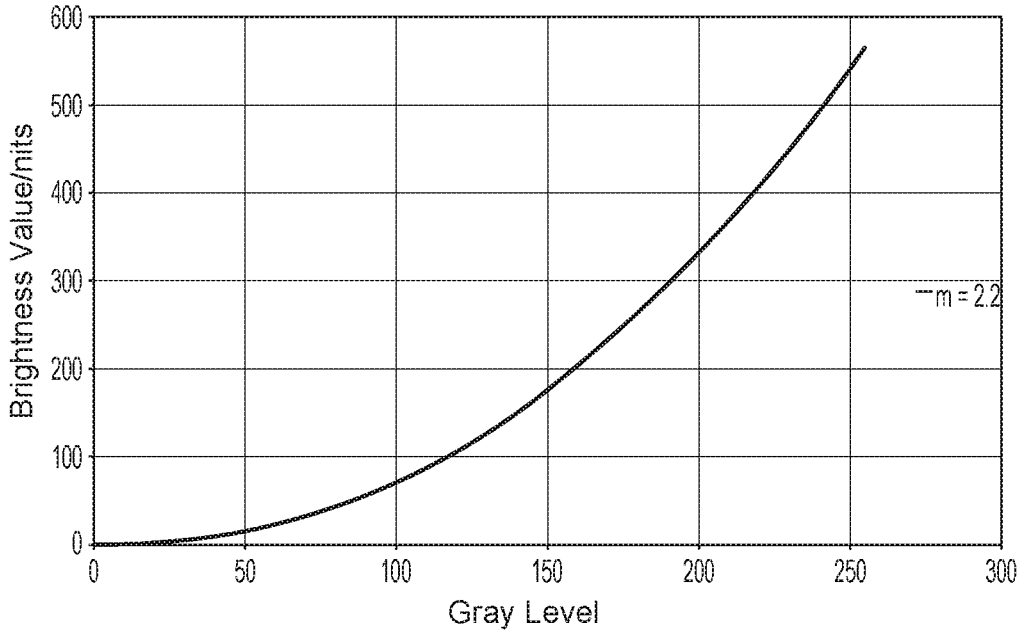
FIG. 1 is a schematic diagram of a gamma curve used when gamma adjustment is performed on a display panel in the prior art.

FIG. 1 is a schematic diagram of a gamma curve used when gamma adjustment is performed on a display panel in the prior art. FIG. 1 specifically illustrates a gamma curve with a gamma value (denoted as m) of 2.2, and the gamma curve can be represented by the following formula (1):

$$L_z = K \times z^m \tag{1}$$

where $L_z$ denotes brightness at gray level z, z denotes the number of gray levels, and K is a constant depending on the display panel. The gamma curve represented by the above formula (1) is generally referred to as an ideal gamma curve.

By taking a display panel having 256 gray levels as an example, according to the ideal gamma curve shown in FIG. 1, the display panel has a brightness of 0 at gray level 0, and has a brightness of $255^m K$ at gray level 255.

In practical adjustment, a value of parameter K of the display panel is first calculated by using the following method: detecting the maximum brightness value $L_{max}$ of the display panel, and calculating the specific value of K by using the maximum brightness value $L_{max}$ according the following formula (2):

$$L_{max} = 255^m K \tag{2}$$

After the specific value of K is obtained, the brightness values of the display panel at gray levels 1 to 254 can be respectively calculated according the above formula (1).

Thus, the brightness values of the display panel at gray levels 0 to 255 are obtained. In the process of gamma adjustment of the display panel, by taking the brightness values of the display panel at gray levels 0 to 255 as standard brightness values, brightness adjustment of the fabricated display panel is performed based on the standard brightness values.

In many practical cases, the brightness value of the fabricated display panel is not 0 at the minimum gray level, that is, not consistent with the corresponding standard brightness value as described above. In this case, if gamma adjustment is performed according to the ideal gamma curve as shown in FIG. 1, brightness differences among low gray levels may be compressed, resulting in that the adjusted display panel cannot display image information at low gray levels clearly.

Embodiments of the present invention provide a novel gamma adjustment method. The gamma adjustment method is used for brightness adjustment for a display panel, particularly, for a display panel whose brightness value is not 0 at the minimum gray level.

Hereinafter, it is assumed that the display panel has (n+1) gray levels, where n is an integer larger than or equal to 2. For example, when the display panel has 256 gray levels, n=255; or when the display panel has 64 gray levels, n=63.

Figure 2:
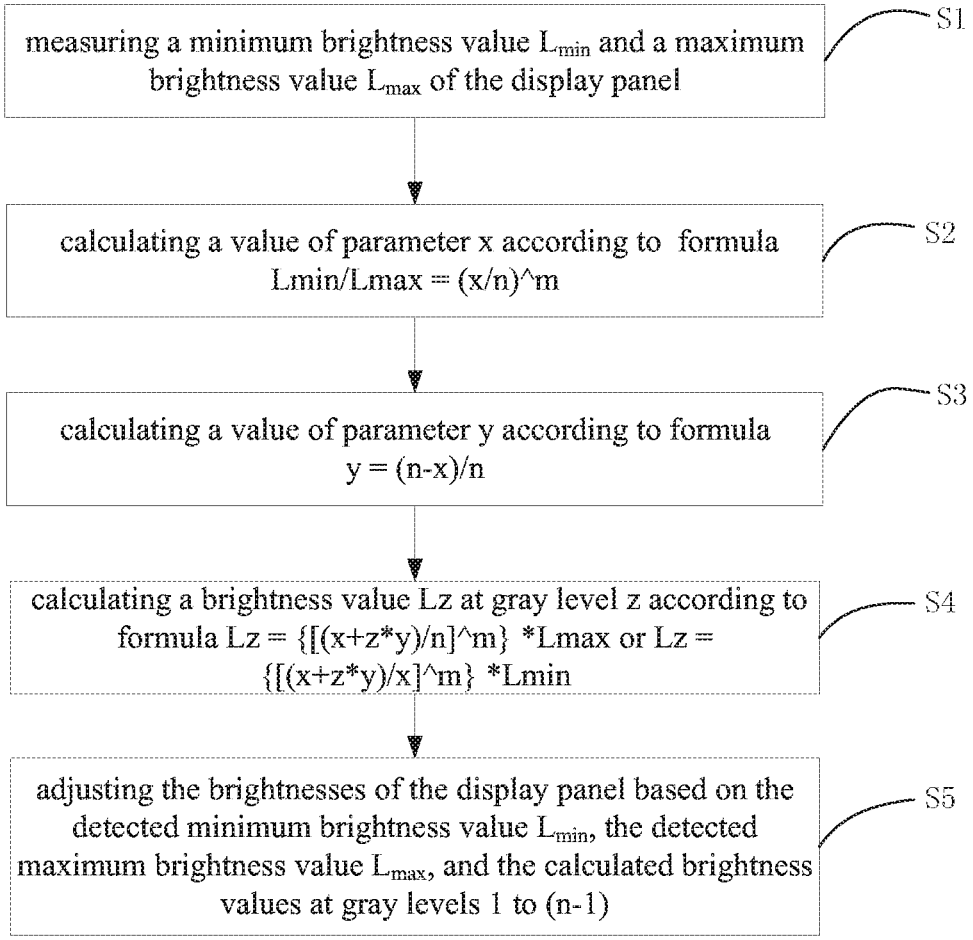
FIG. 2 is a flowchart of a gamma adjustment method according to an embodiment of the present invention.
Figure 3:
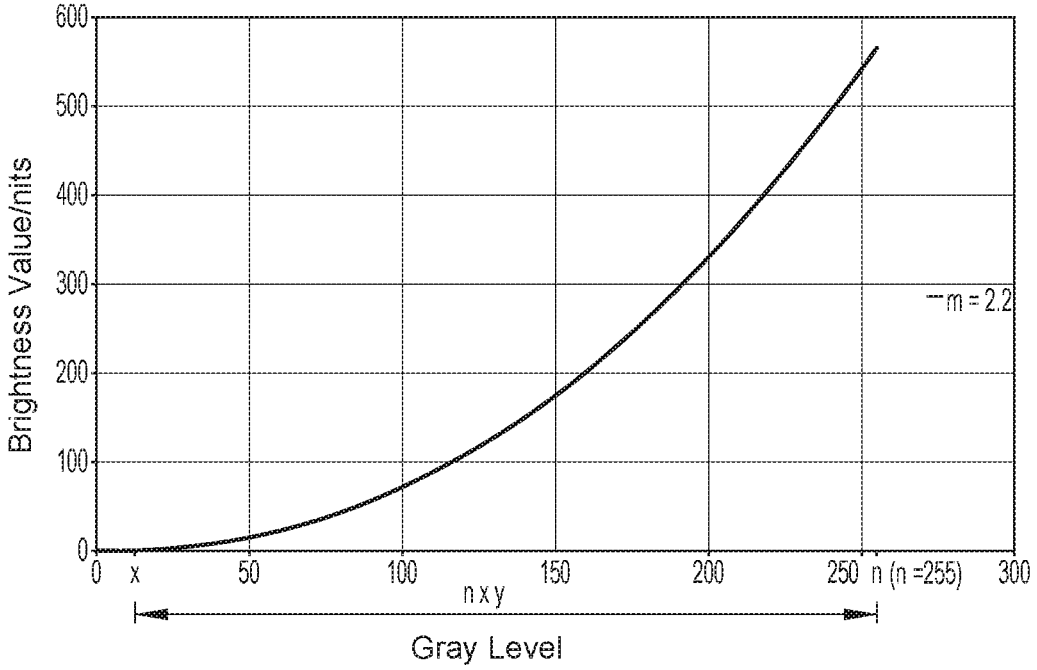
FIG. 3 illustrates a gamma curve used when gamma adjustment is performed on a display panel by using a gamma adjustment method according to an embodiment of the present invention, and the correspondence between the gamma curve and an ideal gamma curve.

FIG. 2 is a flowchart of a gamma adjustment method according to an embodiment of the present invention. As shown in FIG. 2, the gamma adjustment method includes the following steps S1 to S5. FIG. 3 illustrates a gamma curve used when gamma adjustment is performed on a display panel by using a gamma adjustment method according to an embodiment of the present invention, and also illustrates the correspondence between the gamma curve and an ideal gamma curve.

As shown in FIG. 3, the gamma curve used when gamma adjustment is performed on a display panel by using a gamma adjustment method according to the embodiment of the present invention is a part of the curve shown in FIG. 3 whose horizontal coordinate is within a range of [x, n], i.e., a part of the ideal gamma curve whose horizontal coordinate is within a range of [x, n] (the ideal gamma curve further includes a part whose horizontal coordinate is within a range of [0, x)).

Step S1 includes measuring a minimum brightness value $L_{min}$ and a maximum brightness value $L_{max}$ of the display panel, wherein the minimum brightness value $L_{min}$ is a brightness value at gray level 0, and the maximum brightness value $L_{max}$ is a brightness value at gray level n.

In step S1, the brightness value of the display panel is measured by adjusting the brightness of the display panel to the lowest brightness, and the brightness value measured at this time is the brightness value $L_{min}$ of the display panel at gray level 0; the brightness value of the display panel is measured by adjusting the brightness of the display panel to the highest brightness, and the brightness value measured at this time is the brightness value $L_{max}$ of the display panel at gray level n.

Step S2 includes calculating a value of a first intermediate parameter x according to a formula of $$\frac{L_{min}}{L_{max}} = \left(\frac{x}{n}\right)^m,$$

where m is a gamma value of the display panel. Herein, it is assumed that the gamma value of the display panel is known and may have a specific value of 2.2.

Specifically, if the minimum brightness value $L_{min}$ detected in step S1 is not equal to 0, it indicates that the brightness value of the display panel at the lowest gray level (i.e., gray level 0) is not 0, and in this case, gamma adjustment cannot be performed on the display panel by directly using the ideal gamma curve as shown in FIG. 1, otherwise problems existing in the prior art will occur. Under this circumstance, it is assumed that the minimum brightness value $L_{min}$ is equal to the brightness value of the display panel at gray level x in the ideal gamma curve, and thus the following formula (3) can be obtained according to the above formula (1):

$$L_{min} = K \times x^m \tag{3}$$

Since the maximum brightness value $L_{max}$ is the brightness value of the display panel at the highest gray level (i.e., gray level n), the following formula (4) can be obtained according to the above formula (1):

$$L_{max} = K \times n^m \tag{4}$$

By combining formula (3) and formula (4), the following formula (5) can be obtained:

$$\frac{L_{min}}{L_{max}} = \left(\frac{x}{n}\right)^m, \quad (5)$$

Since the minimum brightness value $L_{min}$, the maximum brightness value $L_{max}$, the gamma value m and the value of n are known, the value of the first intermediate parameter x can be calculated according to formula (5), and thus it can be learned at which gray level the brightness in the ideal gamma curve is equivalent to the brightness of the display panel at the lowest gray level.

It should be noted that even if the minimum brightness value $L_{min}$ measured in step S1 is equal to 0, step S2 can be performed; but in this case, the obtained value of x will be 0.

Step S3 includes calculating a value of a second intermediate parameter y according to a formula of $$y = \frac{n-x}{n}.$$

After the value of the first intermediate parameter x is calculated, it means coordinates, corresponding to gray level 0 and gray level n of the display panel, in the ideal gamma curve shown in FIG. 1 are obtained, and there are (n−1) gray levels between gray level 0 and gray level n, so gray level difference, corresponding to two adjacent gray levels (one gray level) of the display panel, in the coordinate system of the ideal gamma curve can be calculated by using positions, corresponding to gray level 0 and gray level n of the display panel, in the ideal gamma curve and the number (i. e., n−1) of gray levels between gray level 0 and gray level n according the following formula (6):

$$y = \frac{n-x}{n} \quad (6)$$

The second intermediate parameter is a gray level difference, corresponding to two adjacent gray levels of the display panel, in the ideal gamma curve, and thus it can be obtained which gray level in the ideal gamma curve is equivalent to each of gray levels 1 to (n−1) of the display panel. For example, it is assumed that n=255, and x=11, it can be calculated that the second intermediate parameter y≈0.9569 according to the above formula (6), and it can be further obtained that the brightness of the display panel at gray level 1 is equivalent to the brightness at gray level 11.9569 (=(11+y)) in the ideal gamma curve, the brightness of the display panel at gray level 2 is equivalent to the brightness at gray level 12.9137 (=(11+2y)) in the ideal gamma curve, the brightness of the display panel at gray level 3 is equivalent to the brightness at gray level 13.8706 (=(11+3y)) in the ideal gamma curve, the brightness of the display panel at gray level 4 is equivalent to the brightness at gray level 14.8275 (=(11+4y)) in the ideal gamma curve . . . the brightness of the display panel at gray level 254 is equivalent to the brightness at gray level 254.0431 (=(11+254y)) in the ideal gamma curve.

Step S4 includes calculating a brightness value Lz at gray level z according to a formula of $$L_z = \left(\frac{x+z\times y}{n}\right)^m \times L_{max}, \text{ or } L_z = \left(\frac{x+z\times y}{x}\right)^m \times L_{min},$$

where z is an integer ranging from 1 to (n−1).

After calculating at which gray level the brightness in the ideal gamma curve is equivalent to the brightness of the display panel at each of gray levels 1 to (n−1), the brightness values of the display pane at gray levels 1 to (n−1) can be calculated. Specifically, according to the ideal gamma curve, the brightness value $L_z$ at gray level z and the maximum brightness value $L_{max}$ have the following relationship:

$$\frac{L_z}{L_{max}} = \left(\frac{x+z\times y}{n}\right)^m \quad (7)$$

Thus, the brightness value $L_z$ of the display panel at gray level z can be calculated according to the above formula (7). By sequentially taking the value of z to be each integer ranging from 1 to (n−1), the brightness values of the display panel at gray levels 1 to (n−1) can be calculated.

In addition, according to the ideal gamma curve, the brightness value $L_z$ at gray level z and the minimum brightness value $L_{min}$ have the following relationship:

$$\frac{L_z}{L_{min}} = \left(\frac{x+z\times y}{x}\right)^m \quad (8)$$

The brightness value $L_z$ of the display panel at gray level z can also be calculated according to the above formula (8). By sequentially taking the value of z to be an integer ranging from 1 to (n−1), the brightness values of the display panel at gray levels 1 to (n−1) can be calculated. However, it should be note that, calculation of the brightness value $L_z$ at gray level z according to formula (8) can be feasible only when the minimum brightness value $L_{min} \neq 0$.

Specifically, FIG. 4 may be referred to, which illustrates a comparison between brightness, at each gray level, of a display panel having 256 gray levels after undergoing gamma adjustment by directly using an existing ideal gamma curve, and brightness, at each gray level, of the display panel after undergoing gamma adjustment by using a gamma adjustment method according to the embodiments of the present invention in a table. In the table shown in FIG. 4, brightness value 2 represents a brightness value, at each gray level, of the display panel after undergoing gamma adjustment by directly using the ideal gamma curve, and brightness value 1 represents a brightness value, at each gray level, of the display panel after undergoing gamma adjustment by using a gamma adjustment method according to the embodiments of the present invention. By comparing brightness value 1 and brightness value 2, after gamma adjustment by directly using the existing ideal gamma curve, a difference between brightness values of the display panel at gray level 2 and gray level 1 is 0.010320914, a difference between brightness values of the display panel at gray level 3 and gray level 2 is 0.018997272, a difference between brightness values of the display panel at gray level 4 and gray level 3 is 0.028425194 . . . . After gamma adjustment by using the gamma adjustment method according to the embodiments of the present invention, a difference between brightness values of the display panel at gray level 2 and gray level 1 is 0.110600422, a difference between brightness values of the display panel at gray level 3 and gray level 2 is 0.122063831, a difference between brightness values of the display panel at gray level 4 and gray level 3 is 0.133709738. . . . It can be seen that the display panel having undergone gamma adjustment by using the gamma adjustment method according to the embodiments of the present invention has larger brightness differences between adjacent gray levels among low gray levels, and thus can display image information at low gray levels more clearly.

Step S5 includes adjusting the brightnesses of the display panel based on the measured minimum brightness value $L_{min}$, the maximum brightness value $L_{max}$, and the calculated brightness values at gray levels 1 to (n−1).

In step S5, the fabricated display panel is adjusted by taking the measured brightness value $L_{min}$ at gray level 0, the brightness value $L_{max}$ at gray level n, and the calculated brightness values at gray levels 1 to (n−1) as the standard brightness values.

In practical applications, after step S4 and before step S5, the brightness values of the display panel at a part of the gray levels may be adjusted adaptively according to visual perception of different users, and the fabricated display panel is adjusted by taking the adjusted brightness values of the display panel at respective gray levels as the standard brightness values.

From the above, in the gamma adjustment method provided by the embodiments of the present invention, the minimum brightness value $L_{min}$ and the maximum brightness value $L_{max}$ of the display panel are detected to determine positions of gray level 0 and gray level n of the display panel in the ideal gamma curve, then gray level difference, corresponding to adjacent gray levels of the display panel, in the ideal gamma curve is calculated based on the positions of gray level 0 and gray level n of the display panel in the ideal gamma curve, thus positions of gray levels 1 to (n−1) of the display panel in the ideal gamma curve can be calculated, and based on this, the brightness values of the display panel at gray levels 1 to (n−1) can be calculated according to the ideal gamma curve; the fabricated display panel may be adjusted by taking the detected brightness value $L_{min}$ at gray level 0, the calculated brightness values at gray levels 1 to (n−1), and the detected brightness value $L_{max}$ at gray level n as the standard brightness values. As compared with the prior art, even when the minimum brightness value $L_{min}$ of the display panel is not equal to 0, brightness differences of the display panel at low gray levels can be avoided from being compressed, and the brightness differences of the display panel between adjacent gray levels among low gray levels become larger, thereby ensuing display effect of image information at low gray levels.

It can be understood that, the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as falling within the protection scope of the present invention.

The invention claimed is:

1. A gamma adjustment method for adjusting brightnesses of a display panel, wherein the display panel has (n+1) gray levels, where n is an integer larger than or equal to 2, and the gamma adjustment method comprises:

measuring a minimum brightness value $L_{min}$ and a maximum brightness value $L_{max}$ of the display panel; wherein the minimum brightness value $L_{min}$ is a brightness value at gray level 0, and the maximum brightness value $L_{max}$ is a brightness value at gray level n;

calculating a value of a first intermediate parameter x according to a formula of $$\frac{L_{min}}{L_{max}} = \left(\frac{x}{n}\right)^m,$$

where m is a gamma value of the display panel and is a value greater than zero;

calculating a value of a second intermediate parameter y according to a formula of $$y = \frac{n-x}{n};$$

calculating a brightness value $L_z$ at gray level z according to a formula of $$L_z = \left(\frac{x + z \times y}{n}\right)^m \times L_{max},$$

where z is an integer ranging from 1 to (n−1); and adjusting the brightnesses of the display panel based on the measured minimum brightness value $L_{min}$, the measured maximum brightness value $L_{max}$, and the calculated brightness values at gray level 1 to gray level (n−1).

2. The gamma adjustment method according to claim 1, wherein the gamma value m of the display panel is equal to 2.2.

3. The gamma adjustment method according to claim 1, wherein the number of gray levels of the display panel is 256 or 64.

4. The gamma adjustment method according to claim 1, wherein after calculating the brightness values at gray level 1 to gray level (n−1), and before adjusting the brightnesses of the display panel, brightness values of the display panel at part of the (n+1) gray levels are adjusted adaptively according to visual perception of different users.

5. The gamma adjustment method according to claim 1, wherein in a step of calculating a brightness value $L_z$ at gray level z according to the formula of $$L_z = \left(\frac{x + z \times y}{n}\right)^m \times L_{max},$$

a value of z is made to be equal to integers ranging from 1 to (n−1) sequentially, so as to calculate the brightness values of the display panel at gray level 1 to gray level (n−1).

* * * * *